US008528255B2

(12) United States Patent
Lambertini

(10) Patent No.: US 8,528,255 B2
(45) Date of Patent: Sep. 10, 2013

(54) OUTWARD OPENING WINDOW UNIT

(75) Inventor: Marco Lambertini, San Lazzaro di Savena (IT)

(73) Assignee: GSG International S.p.A., Budrio (IT)

( * ) Notice: Subject to any disclaimer, the term of this patent is extended or adjusted under 35 U.S.C. 154(b) by 0 days.

(21) Appl. No.: 13/558,029

(22) Filed: Jul. 25, 2012

(65) Prior Publication Data

US 2013/0025207 A1 Jan. 31, 2013

(30) Foreign Application Priority Data

Jul. 29, 2011 (IT) ..... BO2011A0474

(51) Int. Cl.
*E05F 11/10* (2006.01)

(52) U.S. Cl.
USPC ..... 49/192; 49/193; 49/395

(58) Field of Classification Search
USPC ..... 49/394, 395, 192, 193; 292/32, 292/33, 42, 137, 138, 145, DIG. 20, DIG. 47
See application file for complete search history.

(56) References Cited

U.S. PATENT DOCUMENTS

| | | | | | |
|---|---|---|---|---|---|
| 3,660,936 | A * | 5/1972 | Bryson | 49/209 |
| 3,866,355 | A * | 2/1975 | Jacob | 49/192 |
| 3,879,894 | A * | 4/1975 | Anderson | 49/420 |
| 3,994,093 | A * | 11/1976 | Mayer et al. | 49/192 |
| 4,035,953 | A * | 7/1977 | Bierlich | 49/192 |
| 4,208,838 | A * | 6/1980 | Kleine et al. | 49/192 |
| 4,392,329 | A * | 7/1983 | Suzuki | 49/356 |
| 4,532,673 | A * | 8/1985 | Kim | 16/233 |
| 4,679,352 | A * | 7/1987 | Bates | 49/192 |
| 4,739,583 | A * | 4/1988 | Tonsmann et al. | 49/192 |
| 5,226,256 | A * | 7/1993 | Fries et al. | 49/13 |
| 5,881,498 | A * | 3/1999 | Goggin et al. | 49/192 |
| 6,477,810 | B2 * | 11/2002 | Van De Keuken | 49/395 |
| 7,017,301 | B2 * | 3/2006 | Balbo Di Vinadio | 49/192 |
| 7,100,327 | B2 * | 9/2006 | Rangabasyam et al. | 49/395 |
| 7,213,530 | B2 * | 5/2007 | Dasilva et al. | 114/117 |
| 7,340,860 | B2 * | 3/2008 | Balbo Di Vinadio | 49/192 |
| 7,644,538 | B2 * | 1/2010 | Balbo Di Vinadio | 49/192 |
| 7,788,851 | B2 * | 9/2010 | Curtis et al. | 49/395 |
| 8,051,604 | B2 * | 11/2011 | Diekmann et al. | 49/192 |
| 8,099,907 | B2 * | 1/2012 | Balbo Di Vinadio | 49/506 |
| 8,161,683 | B2 * | 4/2012 | Van Parys | 49/192 |
| 8,205,392 | B2 * | 6/2012 | Balbo Di Vinadio | 49/506 |
| 8,240,089 | B2 * | 8/2012 | Lambertini | 49/425 |

(Continued)

FOREIGN PATENT DOCUMENTS

| | | |
|---|---|---|
| DE | 19607366 A1 | 8/1997 |
| DE | 20316561 U1 | 1/2004 |
| WO | 2011036639 A1 | 3/2011 |
| WO | 2011036641 A1 | 3/2011 |

*Primary Examiner* — Katherine Mitchell
*Assistant Examiner* — Justin Rephann
(74) *Attorney, Agent, or Firm* — Pearne & Gordon LLP

(57) ABSTRACT

An outward opening window unit includes: a fixed frame, a movable frame connected to the fixed frame through hinge arms; an operating unit located on the fixed frame to move the movable frame; a structure to close the movable frame on the fixed frame; a handle associated with the fixed frame and connected to the operating unit. The fixed frame has a perimeter channel defining a groove provided with two undercuts for the coupling of operating rods connected to the operating unit, a corner element for transmission of motion being positioned at a corner formed by the fixed frame; the corner element is provided with a structure configured to connect two corresponding rods so as to synchronize the movement imparted to them by the operating unit.

8 Claims, 6 Drawing Sheets

(56) References Cited

U.S. PATENT DOCUMENTS

| | | | | |
|---|---|---|---|---|
| 8,281,519 | B2 * | 10/2012 | Lambertini | 49/221 |
| 2004/0163317 | A1 * | 8/2004 | Reich et al. | 49/209 |
| 2005/0246979 | A1 * | 11/2005 | Balbo Di Vinadio | 52/204.1 |
| 2007/0011948 | A1 * | 1/2007 | Rangabasyam et al. | 49/395 |
| 2008/0016773 | A1 * | 1/2008 | Di Vinadio | 49/192 |
| 2008/0016774 | A1 * | 1/2008 | Vinadio | 49/192 |
| 2008/0016782 | A1 * | 1/2008 | Balbo Di Vinadio | 49/506 |
| 2009/0013605 | A1 * | 1/2009 | Seo | 49/279 |
| 2011/0308169 | A1 * | 12/2011 | Lambertini | 49/417 |
| 2012/0174487 | A1 | 7/2012 | Lambertini | |
| 2012/0180392 | A1 | 7/2012 | Lambertini | |

* cited by examiner

OUTWARD OPENING WINDOW UNIT

This invention relates to an outward opening window unit, which is opened by pushing the movable frame towards the outside. Outward opening window units addressed by this invention come in different types: windows with traditional opening style, referred to in the jargon of the trade as "side hung", or windows hinged at the top, referred to as "top hung".

Outward opening window units of this type, usually made of metal, PVC or the like and of wood, are used for airing rooms and the parts of the windows inside the rooms are often equipped with accessories such as fly screens. In addition, to comply with safety regulations in the countries in which these window units are most widely used, these window units must have controlled opening with a limit on the angle achievable by the sash moving away from the fixed frame, the limit often being fixed by a pushing/pulling arm.

In the prior art, an outward opening window unit basically comprises:

- a fixed frame;
- a movable frame connected to the fixed frame usually by
- a pair of hinged arms interposed between the respective upper and lower crosspieces of the two frames (side hung) or interposed between the uprights of the two frames, towards the top of them (top hung);
- an operating unit located on the crosspiece of the fixed frame and acting directly on the lower crosspiece of the movable frame to allow the movable frame to move away from the fixed frame (that is to say, controlled opening of the movable frame) and also to allow the movable frame to return in contact with the fixed frame;
- an element for stably closing the movable frame on the fixed frame, the element usually being located on an upright of the fixed frame and acting on the respective upright of the movable frame in order to stabilize closure.

Up to now, windows of this type have had in common the fact that their operating units and their closing units have separate structures and controls.

In other words, the necessary presence of two separate units, one for operating and one for closing, makes a window unit structured in that way complex to make and hence expensive overall, as well as making operation complex for the user (who is obliged to go through various steps to open and close the window).

To simplify the structure of outward-opening windows, the Applicant has made a combined operating and closing unit disclosed in patent publications WO 2011/036639 and WO 2011/036641.

This solution combines in a single control unit equipped with a handle (located on the upright or on the lower crosspiece of the fixed frame, depending on whether the window is side hung or top hung) the mechanisms used for the two unlock and open or close and lock operations on the movable frame.

The unit has a slide combined with a kinematic pair connected to a single handle which the user can simply turn to perform all the above operations intuitively, easily, and conveniently.

It should be noted that this control unit is used, in particular, on frames with tubular profiles and is fixed to a flat surface of the tube using a guide which slidably supports the drive rods that transfer the control movement applied by the handle.

In effect, the drive rods have closing pins or bosses on the ends of them to interact with striker elements mounted on the movable frame.

This control unit makes the window extremely practical to operate and secure in the closed configuration.

Based on a structure of this kind, the Applicant has noticed that, for added security, larger-than-standard windows are required to have two or more closing points also on the sides of the window that are not fitted with the control unit, that is to say the frame members without the control unit as mentioned above (uprights in the case of a top-hung window or crosspieces in the case of a side hung window).

This is, however, true also for small windows installed at the lower storeys of a building where the need for improved security of windows in the closed configuration is more strongly felt.

At present, with the closing unit described above, this need might be met with a multiple closure system.

This type of solution, however, leads to at least two problems, linked to:

- the current structuring of prior art frames which do not provide enough internal space for drive rods with closing bosses on different members of the fixed frame (uprights and crosspieces); and
- the total absence of right-angle accessories for transmitting motion round the corners of the fixed frame.

This invention therefore has for an aim to overcome these disadvantages by providing an outward opening window unit which can be fitted with a high number of closing points round its perimeter without altering the basic structure of the window and of the control system for opening/closing and locking the window.

A further aim of this invention is to provide a process for making an outward opening window and the accessories needed to make a multiple closure system.

According to the invention, this aim is achieved by an outward opening window where the fixed frame has a perimeter channel running along an inside surface of the profile constituting the fixed frame; the channel defines a groove provided with two undercuts for the slidable coupling, inside the profile, of operating rods which are connected to a window operating unit and which are furnished with means for closing a movable frame relative to the fixed frame.

Also according to the invention, the window comprises at least one corner drive element for transmission of motion and composed of two arms joined at right angles and able to be slidably coupled to one of the arms inside the perimeter channel to be positioned at a corner formed by the fixed frame; the corner element is provided with means configured to connect two corresponding rods which are slidably positioned in the channel on two corresponding angled members of the fixed frame so as to synchronize the movement imparted to them by the operating unit. The combination of fixed frame channel and corner element connecting the rods furnished with the closing means on two angled members of the fixed frame makes it possible to reduce the dimensions of these accessories and to provide closing points which are far from the zone where the operating unit is located.

Preferably, the operating unit and a control handle are located on a member of the fixed frame which is free of the hinge arms and the corner element connecting the rods is associated with a corner of the fixed frame which is formed by the member engaged by the operating unit and the member engaged by a hinge arm.

In effect, thanks to the channel and the corner element, closing points can also be mounted on the side of the window where the hinge arms of the selfsame window are located.

Preferably, the fixed frame has a wide slot formed on one or more sides of the perimeter channel and configured to provide access from the front and allow the corner element to slide and the operating rods to be inserted.

Thanks to this slot, the accessories can be fitted, removed and/or adjusted at any time before or after installing the frames which make up the window unit.

The technical features of the invention, with reference to the above aims, are clearly described in the claims below and its advantages are more apparent from the detailed description which follows, with reference to the accompanying drawings which illustrate a preferred non-limiting example embodiment of the invention, and in which:

Figure 1:
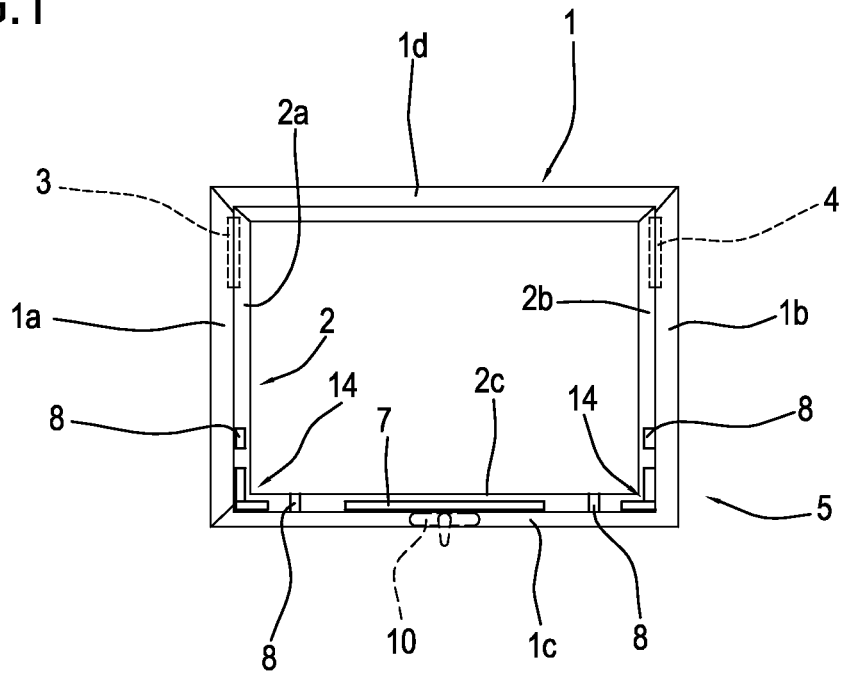
FIG. 1 is a schematic front view of an outward opening window unit according to the invention.
Figure 2:
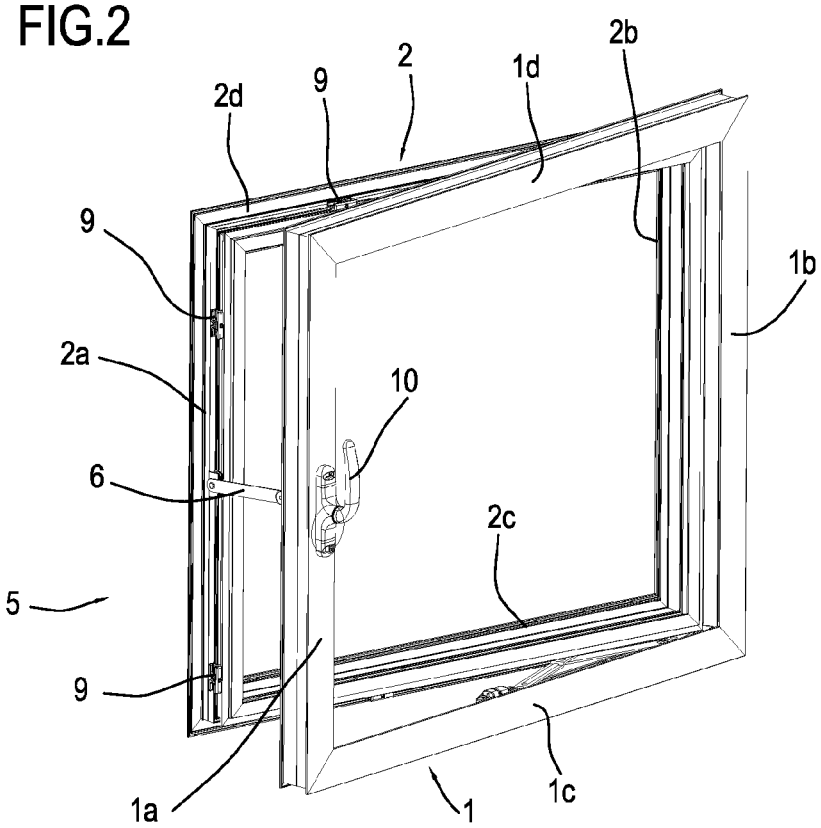
FIGS. 2 and 3 show a side hung outward opening window unit according to the invention, both in perspective views and in an open configuration and with some parts cut away in order to better illustrate others.
Figure 3:
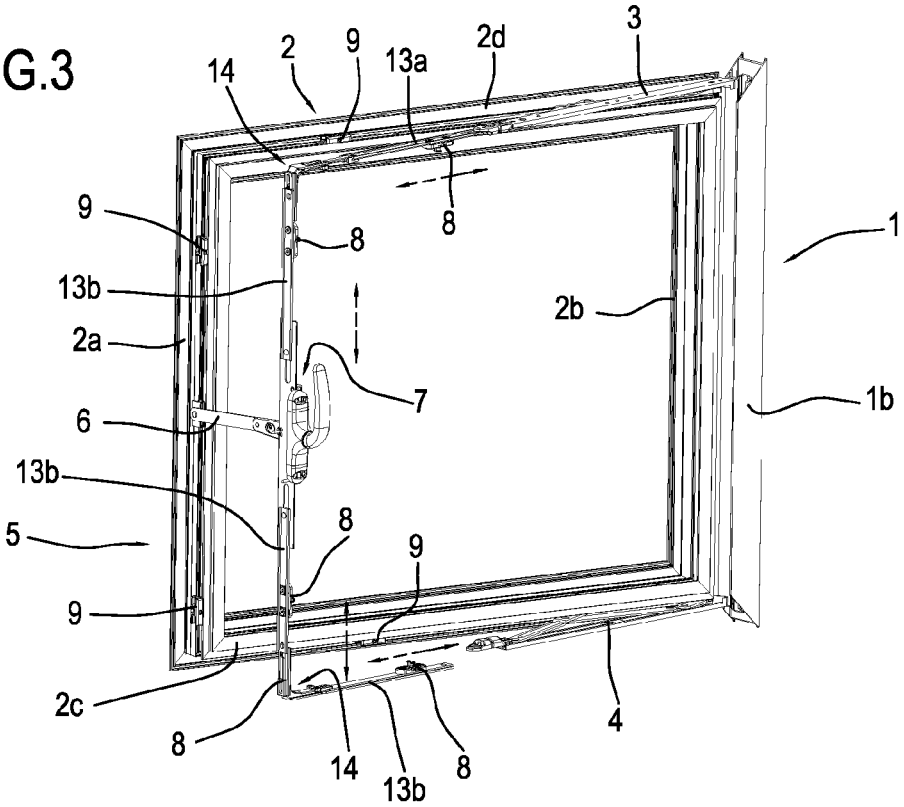

With reference to the accompanying drawings, and in particular with reference to FIGS. 1 to 3, the window unit according to the invention, denoted by the numeral 5, is of the outward opening type, that is to say, with a movable frame that opens towards the outside of the room where the window unit is installed.

More specifically, window units falling within the scope of this invention may be of the type known in the jargon of the trade as "top hung" windows, as illustrated in FIG. 1, or "side hung" windows, as illustrated in FIGS. 2 and 3.

The only difference between these two types of windows lies (as will become clearer as this description continues) in the position of the operating accessories which, although mounted at different points, serve the same function.

The outward opening window unit 5 according to the invention comprises a fixed frame 1 and a movable frame 2.

The fixed frame 1 has a pair of vertical members or uprights 1*a* and 1*b* which are parallel with each other, and a pair of horizontal members or crosspieces 1*c* and 1*d* which are parallel with each other.

The movable frame 2 has a pair of vertical members or uprights 2*a* and 2*b* which are parallel with each other, and a pair of horizontal members or crosspieces 2*c* and 2*d* which are parallel with each other. The movable frame 2 is connected to the fixed frame 1 through a pair of hinge arms 3 and 4 joined to the corresponding members of the fixed frame 1 and of the movable frame 2 to allow roto-translational movement of the movable frame 2 from a closed position to an open position towards the outside of the room where the window unit 5 is installed, and vice versa.

In light of this, see FIGS. 1 to 3, a window unit 5 of the top hung type (FIG. 1) comprises two hinge arms 3 and 4 interposed between the corresponding uprights 1*a*, 1*b* and 2*a*, 2*b* at the top of the two frames 1 and 2, while in the case of a window unit 5 of the side hung type, the hinge arms 3 and 4 are interposed between the respective crosspieces 1*c*, 1*d* and 2*c*, 2*d* of the two frames 1 and 2.

The structure of the hinge arms 3 and 4 is not illustrated or described in detail since it is of known type and does not strictly form part of this invention.

The window unit 5 also comprises at least one movement arm 6 configured to push or pull the movable frame 2 from the closed position to the open position, and vice versa.

The arm 6 is moved by an operating unit 7 mounted on the fixed frame 1 and connected to the selfsame arm 6 in such a way as to move the movable frame 2 relative to the fixed frame 1 from the closed position to the open position, and vice versa.

The operating unit 7 and the arm 6 are not described in detail since they are the objects of two patent publications WO 2011/036639 and WO 2011/036641 in the name of the same Applicant as this invention.

The window unit 5 also comprises means 8 for stably closing or locking/releasing the closed position of the movable frame 2 on the fixed frame 1, these means being connected to the operating unit 7 and acting on the striker elements 9 associated with the movable frame 2.

The closing means 8 may comprise bosses or pins adapted to come into contact with striker plates 9 associated with the movable frame 2.

Both the closing means 8 and the strikers 9 are of known type and not described in detail.

The window unit 5 is also furnished with a handle 10 associated with the outside of the fixed frame 1 and connected to the operating unit 7 in such a way as to manually release the movable frame 2 from the fixed frame 1 and then move the movable frame 2 towards the open position, and vice versa.

In the case of a top hung window, the handle 10, the operating unit 7 and the respective arm 6 are positioned on the lower crosspiece 1*c* of the fixed frame 1 (see FIG. 1).

In the case of a side hung window, the handle 10, the operating unit 7 and the respective arm 6 are positioned on the upright la of the fixed frame 1 (see FIGS. 2 and 3).

Figure 4:
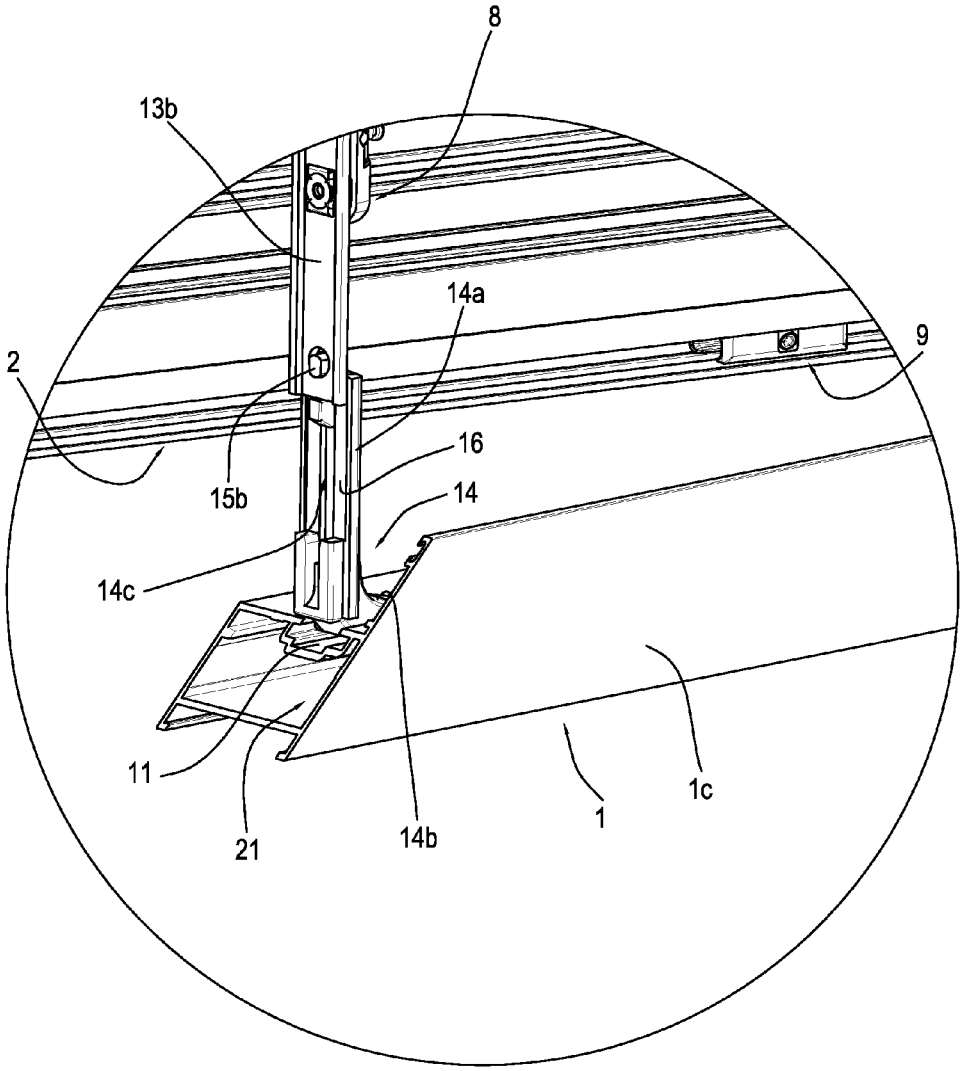
FIG. 4 shows an enlarged detail from FIG. 2 with some parts cut away to better illustrate others.
Figure 5:
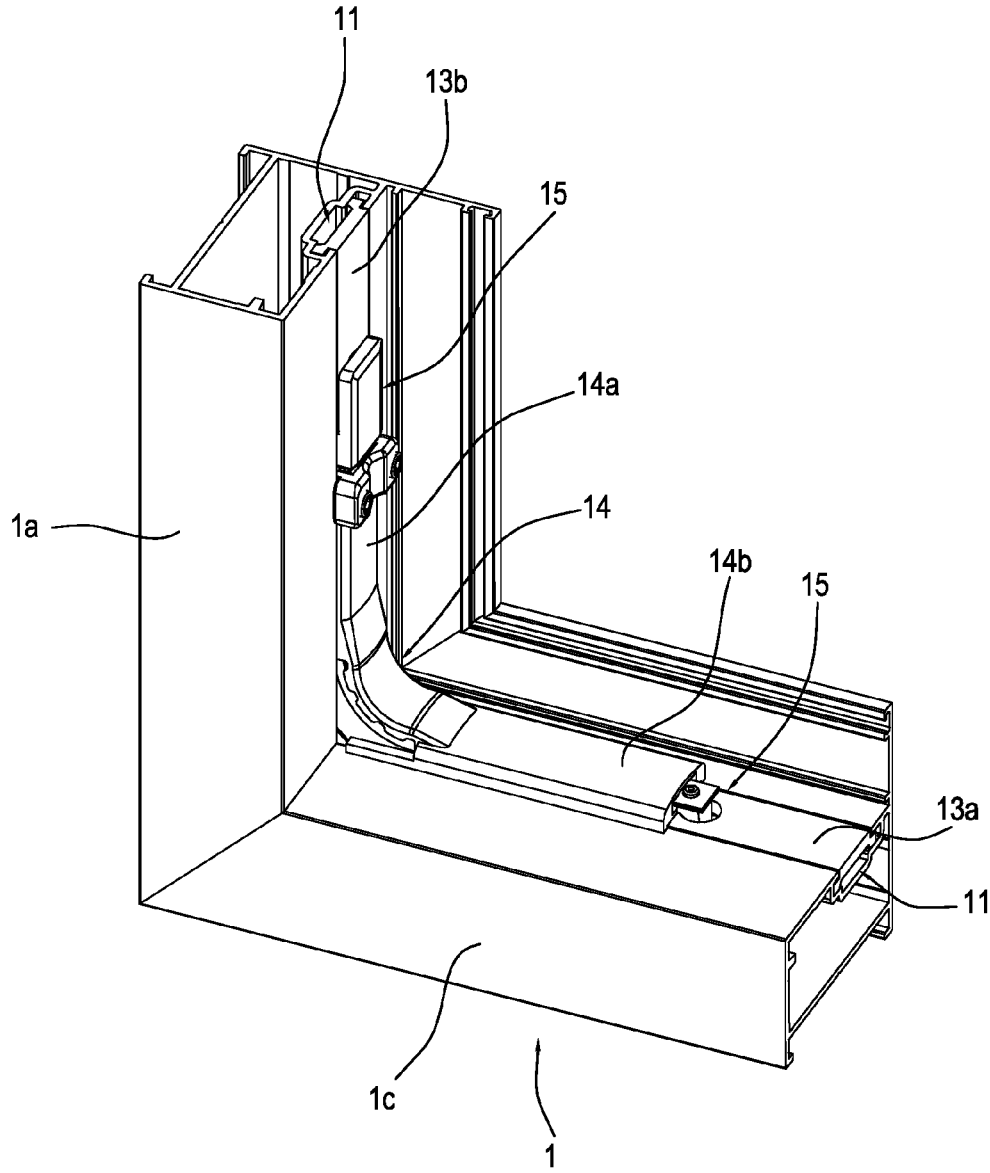
FIG. 5 is another detail from FIGS. 2 and 3, showing in particular a corner element associated with a fixed frame and connected to drive rods, in a perspective view, with some parts cut away in order to better illustrate others.

According to the invention, the fixed frame 1 of the window unit comprises a perimeter channel 11 running along an inside surface of the profile constituting the selfsame fixed frame 1 (see FIGS. 4 and from 6 to 8).

Also according to the invention, the channel 11 defines a groove provided with at least two undercuts 12 for the slidable coupling of operating rods 13*a*, 13*b*, connected to the operating unit 7, and furnished with the closing means 8.

According to the invention, the window unit 5 yet further comprises at least one corner drive element 14 for transmission of motion and composed of two arms 14*a*, 14*b* joined to each other and able to be slidably coupled to one of the arms 14*a* or 14*b* inside the perimeter channel 11 to be positioned at a corner formed by the fixed frame 1.

Also according to the invention, the corner element 14 is provided with means 15 configured to connect two corresponding rods 13*a*, 13*b* which are slidably positioned in the channel 11 on two corresponding angled members of the fixed frame 1 in such a way as to synchronize the movement imparted to them by the operating unit 7.

In this specification, the inside surface of the fixed frame 1 is the surface which, when the window 5 is closed, faces a corresponding surface of the movable frame 2 on which the hinge arms 3, 4, the closing means 8, the striker elements 9 and the operating unit 7 are mounted.

The two rods 13*a* and 13*b* are positioned on both sides of the corner element 14 which connects them so as to synchronize their movement when the operating unit 7 imparts to the rod 13*a* or 13*b*, which is connected directly to the selfsame unit 7, the movement from the handle 10.

The combined presence of the channel 11 on the fixed frame 1 and of the corner drive element 14 makes it possible to:

house in reduced and confined spaces the accessories necessary to move the closing means 8 without affecting the other accessories and the size of the fixed and movable frames;

place two or more closing points even on the members of the frames 1 and 2 where the hinge arms 3 and 4 are mounted.

In light of this, still with reference to FIGS. 1 to 3, if the operating unit 7 and the handle 10 are mounted on one of the fixed frame 1 members which is free of the hinge arms 3 and 4 (crosspiece in FIG. 1, upright in FIGS. 2 and 3), the corner element 14 connecting the rods 13*a* and 13*b* is associated with its arms 14*a* and 14*b* at a corner of the fixed frame 1 made by the member engaged by the operating unit 7 and the member engaged by a hinge arm 3, 4.

Thus, in the case of a window unit 5 like that of FIG. 1, the corner elements 14 connect the rods 13*a* and 13*b* (with closing means 8) from the zone of the crosspiece 1*c* to the uprights 1*a* and 1*b* and slide upon the action of the unit 7 and of the handle 10 located on the selfsame crosspiece 1*c*.

In the case of a window unit 5 like that of FIGS. 2 and 3, the corner elements 14 connect the rods 13*a*, 13*b* (with the closing means 8) from the zone of the upright 1*a* to the crosspieces 1*c*, 1*d* and slide upon the action of the unit 7 and of the handle 10 located on the upright 1*a*.

In both cases, the rods 13*a*, 13*b* located on the members of the fixed frame 1 where the hinge arms 3, 4 are mounted extend for a length that is calculated as a function of the size of the respective hinge arm 3 or 4 so as not to interfere with the latter as they slide.

Preferably, one of the arms 14*a*, 14*b* of the corner element 14 (see FIGS. 10 to 12) is furnished with guides 16 which allow sliding along the channel 11 on the fixed frame 1 and which are configured to position and hold the corner element 14 against the selfsame fixed frame 1.

Further, the other of the arms 14*a*, 14*b* of the corner element 14 is configured to rest on the profile of the fixed frame 1.

Preferably, the guides 16 are configured to be coupled to the profile of the channel 11 formed on the fixed frame 1.

The above mentioned means 15 for connecting the corner element 14 to the rods 13*a*, 13*b* are located inside the corner element 14 and are configured to protrude at least partially into the channel 11.

Figure 10:
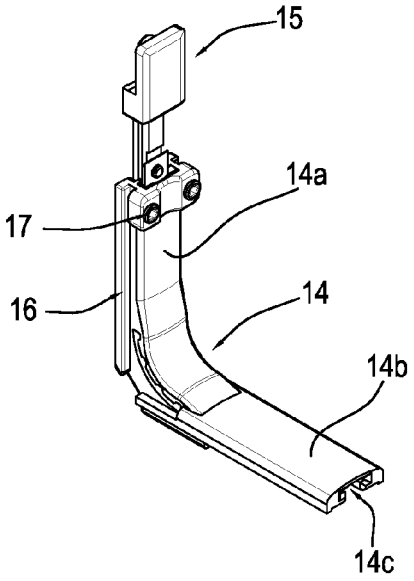
FIGS. 10, 11 and 12 are respectively, a perspective view, an exploded perspective view and a side view of a corner element applicable to the window unit of the preceding figures.
Figure 11:
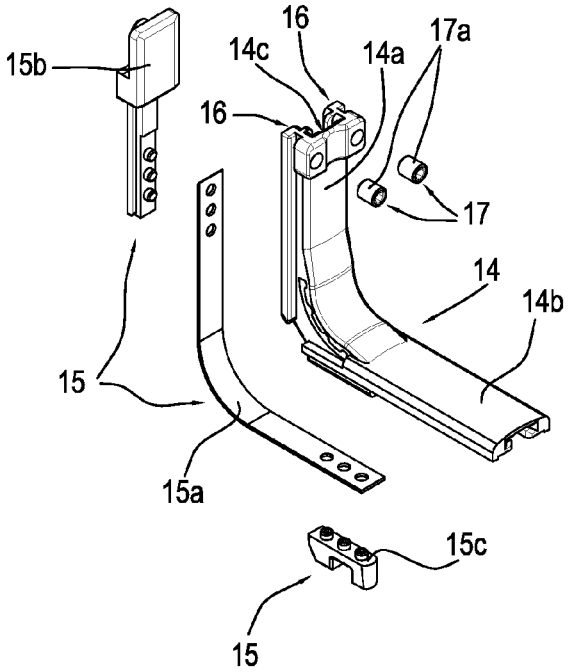
Figure 12:
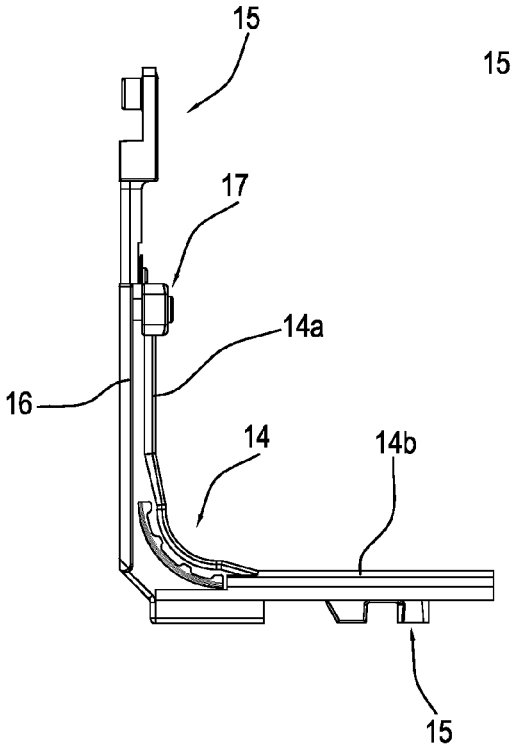

With reference to FIGS. 10 to 12, the means 15 may comprise a flexible bar 15*a* slidable inside a channel 14*c* of the corner element 14. The bar 15*a* has sockets for coupling its two ends to two end pieces 15*b*, 15*c*, each of which is equipped with teeth protruding operatively into the channel 11.

The teeth are operatively coupled to sockets 13*c* formed on respective rods 13*a*, 13*b*.

Looking in more detail, the corner element 14 is provided with means 17 for fastening it to the surface of the profile of the fixed frame 1 and located on one of the arms 14*a*, 14*b*.

Preferably, the means 17 are located and operative on the arm 14*a* which is equipped with the guides 16 for sliding along the channel 11 of the fixed frame 1: that way, once the corner element 14 has been placed on the fixed frame 1, by making it slide along the fixed frame 1, the selfsame corner element 14 can be fixed at the required position.

In light of this, the fastening means 17 may comprise a pair of screws 17*a* accommodated in through holes made in the arm 14*a* and designed to lock the arm 14*a* itself by contact with the profile of the fixed frame 1 at the channel 11.

Figure 9:
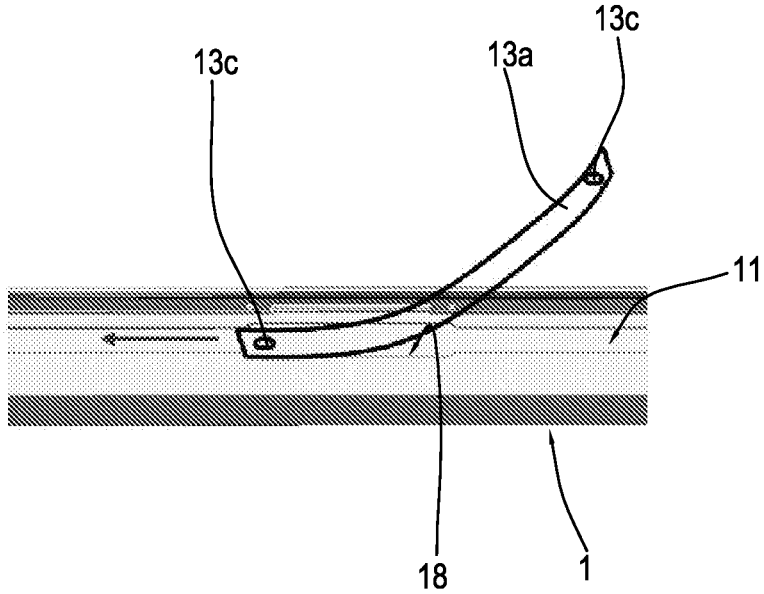
FIG. 9 illustrates a portion of the profile making up the fixed frame of the window unit, where it is coupled to a drive rod.

Preferably, the fixed frame 1 has a wide slot 18 (see FIGS. 6 to 8) formed on each side of the perimeter channel 11 and configured to provide access from the front for the arm 14*a* of the corner element 14 furnished with the guides 16 to allow the sliding and insertion of the operating rods 13*a* and 13*b* (see FIG. 9).

Figure 6:
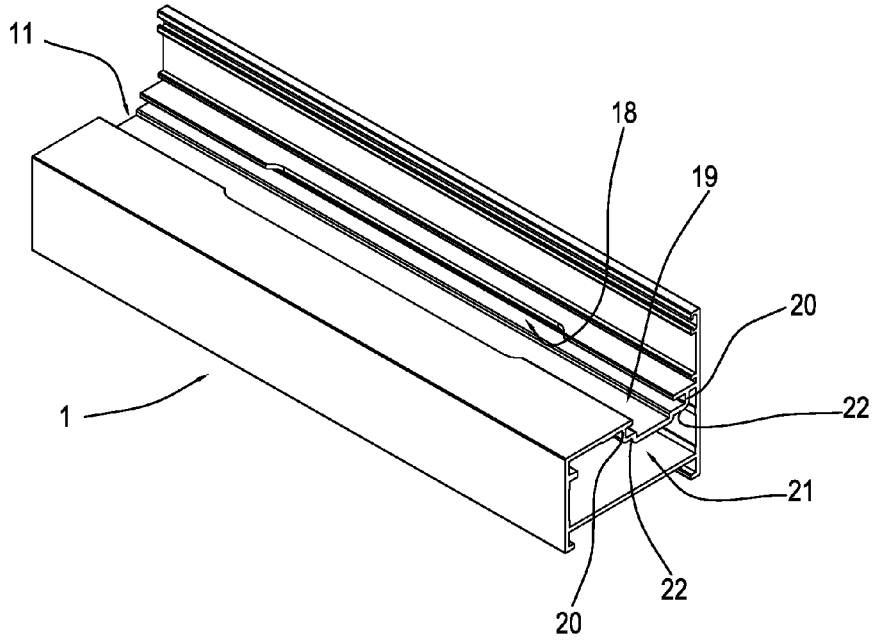
FIGS. 6 and 7 are, respectively, a perspective view and a top plan view of a portion of a profile making up the fixed frame of the window unit of the preceding figures.
Figure 7:
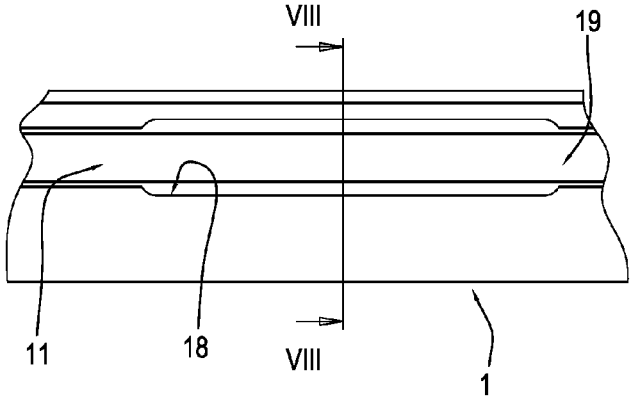
Figure 8:
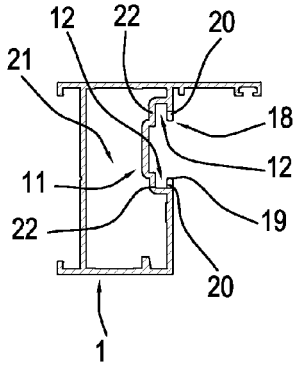
FIG. 8 is cross section through line VIII-VIII of FIG. 7.

Still with reference to FIGS. 6 to 8, the channel 11 of the fixed frame 1 comprises a central opening 19 (which is wider in the zone where the slot 18 is made).

The opening 19 is delimited by two mutually opposed flanges 20 made on the inside surface of the profile.

The profile from which the fixed frame 1 is made has an internal tubular chamber 21 which accommodates the remaining surface of the channel 11 and which comprises two parallel tracks 22 mutually opposed to the corresponding upper flanges 20 (with which they form the above mentioned undercuts 12) in such a way as to define the sliding supports for the guides 16 of the corner element 14 and for the operating rods 13*a* and 13*b*.

This invention also provides a process for making an outward opening window unit.

The process comprises the steps of:

preparing a fixed frame 1 having a pair of vertical members or uprights 1*a*, 1*b*, parallel with each other, and a pair of horizontal members or crosspieces 1*c*, 1*d* parallel with each other;

preparing a movable frame 2 having a pair of vertical members or uprights 2*a*, 2*b*, parallel with each other, and a pair of horizontal members or crosspieces 2*c*, 2*d* parallel with each other;

associating a pair of hinge arms 3, 4 with corresponding members of the fixed frame 1 and of the movable frame 2;

preparing an operating unit 7 comprising a movement arm 6 and associating the unit with the fixed frame 1;

associating also the movement arm 6 to the movable frame 2;

connecting to the operating unit 7 means 8 for the stable closing or the locking/releasing of the movable frame 2 on the fixed frame 1;

associating with the movable frame 2 striker elements 9 which interact with the closing means 8;

associating a handle 10 with the outside of the fixed frame 1 and connecting the handle 10 to the operating unit 7.

According to the invention, the process also comprises the steps of:

making a channel 11 along the inside surface of the profile constituting the fixed frame 1 during the step of preparing the selfsame fixed frame 1;

coupling at least one corner drive element 14 for transmission of motion inside the channel 11 and positioning it at a corner defined by the fixed frame 1;

inserting operating rods 13*a*, 13*b*, which are furnished with the closing means 8, into the channel 11 of the fixed frame 1 and at least along the two members which form the corner of the fixed frame 1 which is engaged by the corner element 14;

connecting the operating rods 13*a*, 13*b* to the corner element 14.

Preferably, the process comprises a step of making a wide slot 18 in the channel 11 on at least one member of the fixed frame 1 and configured to allow access from the front for the corner element 14 and the subsequent sliding thereof.

Preferably, the step of making the wide slot 18 is performed on at least two contiguous members of the fixed frame 1 and is intended to provide access to and allow sliding of both the corner element 14 and at least two operating rods 13*a*, 13*b*.

Preferably, the slot 18 is made on at least three members of the fixed frame 1, centrally on each of these members.

Preferably, the closing means 8 are connected to the rods 13*a* and 13*b* after the selfsame rods have been inserted into the channel 11.

The invention described above is susceptible of industrial application and may be modified and adapted in several ways without thereby departing from the scope of the inventive concept. Moreover, all the details of the invention may be substituted by technically equivalent elements.

The invention claimed is:

1. An outward opening window unit comprising:

a fixed frame (1) having a pair of vertical members or uprights (1*a*, 1*b*), parallel with each other, and a pair of horizontal members or crosspieces (1*c*, 1*d*) parallel with each other;

a movable frame (2) having a pair of vertical members or uprights (2*a*, 2*b*), parallel with each other, and a pair of horizontal members or crosspieces (2*c*, 2*d*), parallel with each other, the movable frame (2) being connected to the fixed frame (1) by a pair of hinge arms (3, 4) joined to corresponding members of the fixed frame (1) and of the movable frame (2) to allow roto-translational movement of the movable frame (2) from a closed position to an open position towards an outside of a room where the window unit (5) is installed, and vice versa;

at least one movement arm (6) configured to push or pull the movable frame (2) from the closed position to the open position, and vice versa;

an operating unit (7) mounted on the fixed frame (1) and connected to the movement arm (6) in such a way as to move the movable frame (2) relative to the fixed frame (1) from the closed position to the open position, and vice versa;

means (8) for closing or locking/releasing the movable frame (2) on the fixed frame (1), said means (8) being connected to the operating unit (7) and acting on striker elements (9) associated with the movable frame (2);

a handle (10) associated with an outside of the fixed frame (1) and connected to the operating unit (7) in such a way as to manually release the movable frame (2) from the fixed frame (1) and then move the movable frame (2) towards the open position, and vice versa;

wherein the fixed frame (1) has a profile and is provided with a perimeter channel (11) running along an inside surface of the profile; the perimeter channel (11) defining a groove provided with at least two undercuts (12) for slidable coupling of operating rods (13*a*, 13*b*) which are connected to the operating unit (7);

wherein the fixed frame (1) comprises at least one corner drive element (14) for transmission of motion and comprised of two arms (14*a*, 14*b*) and able to be slidably coupled to the perimeter channel (11) and able to be positioned at a corner formed by the fixed frame (1); the corner drive element (14) being provided with connecting means (15) configured to connect the two operating rods (13*a*, 13*b*) which are slidably positioned in the perimeter channel (11) on two corresponding angled members of the fixed frame (1) in such a way so as to synchronize movement imparted to the two operating rods (13*a*, 13*b*) by the operating unit (7), wherein one of the arms (14*a*, 14*b*) of the corner drive element (14) is furnished with guides (16) (a) which allow sliding along the perimeter channel (11) and (b) which are configured to position and hold the corner drive element (14) against the fixed frame (1), and wherein the corner drive element (14) has fastening means (17) for fastening the corner drive element (14) to the surface of the profile; the fastening means (17) being located and operative on the arm (14*a*, 14*b*) which is furnished with the guides (16).

2. The window unit according to claim 1, wherein the operating unit (7) and the handle (10) are located on a member of the fixed frame (1) which is free of the hinge arms (3, 4) and wherein the at least one corner drive element (14) connecting the operating rods (13*a*, 13*b*) is associated with a corner of the fixed frame (1) which is formed by a member engaged by the operating unit (7) and a member engaged by one of the hinge arms (3, 4).

3. The window unit according to claim 1, wherein one of the arms (14*a*, 14*b*) of the corner drive element (14) is configured to rest on the profile of the fixed frame (1).

4. The window unit according to claim 1, wherein the connecting means (15) are located inside the corner drive element (14) and are configured to protrude at least partially into the perimeter channel (11).

5. The window unit according to claim 1, wherein the fixed frame (1) has a slot (18) formed on at least one side of the perimeter channel (11) and configured to provide access from the front at least for the arm (14*a*, 14*b*) of the corner drive element (14) which is furnished with the guides (16).

6. The window unit according to claim 1, wherein the fixed frame (1) has a slot (18) formed on a side of the perimeter channel (11) and configured to provide access from the front for the arm (14*a*, 14*b*) of the corner drive element (14) which is furnished with the guides (16) and to allow the operating rods (13*a*, 13*b*) to be inserted.

7. The window unit according to claim 1, wherein the perimeter channel (11) comprises a central opening (19) delimited by two mutually opposed flanges (20) made on the inside surface of the profile; the profile having an internal tubular chamber (21) which accommodates the remaining surface of the perimeter channel (11) and which comprises two parallel tracks (22) mutually opposed to the corresponding flanges (20) in such a way as to define sliding supports for the guides (16) and for the operating rods (13*a*, 13*b*).

8. An outward opening window unit comprising:

a fixed frame (1) having a pair of vertical members or uprights (1*a*, 1*b*), parallel with each other, and a pair of horizontal members or crosspieces (1*c*, 1*d*) parallel with each other;

a movable frame (2) having a pair of vertical members or uprights (2*a*, 2*b*), parallel with each other, and a pair of horizontal members or crosspieces (2*c*, 2*d*), parallel with each other, the movable frame (2) being connected to the fixed frame (1) by a pair of hinge arms (3, 4) joined to corresponding members of the fixed frame (1) and of the movable frame (2) to allow roto-translational movement of the movable frame (2) from a closed position to an open position towards an outside of a room where the window unit (5) is installed, and vice versa;

at least one movement arm (6) configured to push or pull the movable frame (2) from the closed position to the open position, and vice versa;

an operating unit (7) mounted on the fixed frame (1) and connected to the movement arm (6) in such a way as to move the movable frame (2) relative to the fixed frame (1) from the closed position to the open position, and vice versa;

means (8) for closing or locking/releasing the movable frame (2) on the fixed frame (1), said means (8) being connected to the operating unit (7) and acting on striker elements (9) associated with the movable frame (2);

a handle (10) associated with an outside of the fixed frame (1) and connected to the operating unit (7) in such a way as to manually release the movable frame (2) from the fixed frame (1) and then move the movable frame (2) towards the open position, and vice versa;

wherein the fixed frame (1) has a profile and is provided with a perimeter channel (11) running along an inside surface of the profile; the perimeter channel (11) defining a groove provided with at least two undercuts (12) for slidable coupling of operating rods (13*a*, 13*b*) which are connected to the operating unit (7);

wherein the fixed frame (1) comprises at least one corner drive element (14) for transmission of motion and comprised of two arms (14*a*, 14*b*) and able to be slidably coupled to the perimeter channel (11) and able to be positioned at a corner formed by the fixed frame (1); the corner drive element (14) being provided with connecting means (15) configured to connect the two operating rods (13*a*, 13*b*) which are slidably positioned in the perimeter channel (11) on two corresponding angled members of the fixed frame (1) in such a way so as to synchronize movement imparted to the two operating rods (13*a*, 13*b*) by the operating unit (7), wherein the perimeter channel (11) comprises a central opening (19) delimited by two mutually opposed flanges (20) made on the inside surface of the profile; the profile having an internal tubular chamber (21) which accommodates the remaining surface of the perimeter channel (11) and which comprises two parallel tracks (22) mutually opposed to the corresponding flanges (20) in such a way as to define sliding supports for the guides (16) and for the operating rods (13*a*, 13*b*).

* * * * *